United States Patent [19]

Greenebaum, II

[11] Patent Number: 4,792,067

[45] Date of Patent: Dec. 20, 1988

[54] MOUNTING CUP

[75] Inventor: James E. Greenebaum, II, Highland Park, Ill.

[73] Assignee: Pittway Corporation, Cary, Ill.

[21] Appl. No.: 733,207

[22] Filed: May 13, 1985

[51] Int. Cl.[4] ..... B65D 83/14

[52] U.S. Cl. ..... 222/402.1; 222/542; 413/62

[58] Field of Search ..... 222/402.1, 402.21–402.25, 222/542, 402.16, 402.2; 413/7, 42–44, 58–62; 53/470, 330, 488–489; 220/67, 81 R

[56] References Cited

U.S. PATENT DOCUMENTS

| | | | |
|---|---|---|---|
| 1,890,936 | 12/1932 | Douglass . | |
| 2,047,076 | 6/1936 | Kronquest | 113/121 |
| 2,676,899 | 4/1954 | Hackley | 117/128 |
| 2,781,077 | 2/1957 | Dovidio | 154/41 |
| 2,783,597 | 3/1957 | Hohl et al. | 53/16 |
| 2,837,375 | 6/1958 | Efford et al. | 222/402.25 X |
| 3,036,728 | 5/1962 | Gibb | 220/75 |
| 3,081,906 | 3/1963 | Wenchert | 220/67 |
| 3,102,823 | 9/1963 | Manasia et al. | 427/185 |
| 3,342,381 | 9/1967 | Simons et al. | 222/402.1 |
| 3,417,177 | 12/1968 | Simons et al. | 264/230 |
| 3,443,006 | 6/1969 | Simons et al. | 264/249 |
| 3,512,685 | 5/1970 | Ewald | 222/396 |
| 3,562,049 | 2/1971 | Maher | 156/213 |
| 3,587,942 | 6/1971 | Gailitis | 222/402.24 |
| 3,618,817 | 5/1970 | Troughten | 220/64 |
| 3,657,044 | 4/1972 | Singer | 156/212 |
| 3,669,816 | 6/1972 | Smith et al. | 161/38 |
| 3,702,669 | 11/1973 | Ewald | 222/402.16 |
| 3,745,035 | 7/1973 | Troughton et al. | 117/18 |
| 3,893,882 | 7/1975 | Repenning | 156/287 |
| 3,898,945 | 8/1975 | Robowetz | 113/120 A |
| 3,906,126 | 9/1975 | Kaiser et al. | 428/36 |
| 3,921,574 | 11/1975 | English | 118/106 |
| 3,921,847 | 11/1975 | Rentneester | 220/64 |
| 3,999,357 | 12/1976 | Marantz | 53/27 |
| 4,000,338 | 12/1976 | Burdin | 427/184 |
| 4,003,492 | 1/1977 | Beveridge et al. | 220/62 |
| 4,034,132 | 7/1977 | Manual | 428/36 |
| 4,065,023 | 12/1977 | Rentneester et al. | 220/75 |
| 4,093,102 | 6/1978 | Kraska | 220/67 |
| 4,169,903 | 10/1979 | Scholes | 427/28 |
| 4,183,974 | 1/1980 | Coucher et al. | 427/28 |
| 4,271,208 | 6/1981 | Itoh et al. | 427/28 |
| 4,293,353 | 10/1981 | Pelton et al. | 156/69 |
| 4,308,973 | 1/1982 | Irland | 220/454 |
| 4,350,261 | 9/1982 | Roth | 17/34 |
| 4,353,765 | 10/1982 | Covi et al. | 156/212 |
| 4,423,823 | 1/1984 | Franek et al. | 220/77 |
| 4,448,322 | 5/1984 | Kraska | 220/67 |
| 4,538,758 | 9/1985 | Griffith | 413/7 X |

FOREIGN PATENT DOCUMENTS

| | | | |
|---|---|---|---|
| 033626 | 8/1981 | European Pat. Off. . | |
| 827972 | 6/1938 | France . | |
| 47-16307 | 1/1972 | Japan | 260/ |
| 55-24718 | 2/1980 | Japan | 413/7 |
| 56-84247 | 7/1981 | Japan | 8/18 |
| 8101695 | 6/1981 | PCT Int'l Appl. | 222/402.1 |
| 463797 | 4/1937 | United Kingdom . | |
| 499902 | 9/1937 | United Kingdom . | |
| 478564 | 1/1938 | United Kingdom . | |
| 562876 | 7/1944 | United Kingdom | 220/64 |
| 908909 | 10/1962 | United Kingdom | 222/402.24 |
| 1358334 | 3/1974 | United Kingdom . | |
| 1434351 | 5/1976 | United Kingdom . | |

*Primary Examiner*—Charles A. Marmor

*Attorney, Agent, or Firm*—Frijouf, Rust & Pyle

[57] ABSTRACT

An apparatus and method is disclosed for an improved mounting cup for sealing with a container of an aerosol device. The container includes an annular bead extending about an opening in the container with the annular bead defining an internal surface contour having a generally partially circular cross-section. A mounting cup comprising a peripheral rim is formed for sealing with the annular bead of the container. The peripheral rim has an inner region contour substantially different in shape from the inner surface contour of the annular bead of the container. The inner region contour of the peripheral rim engages with the inner surface contour of the annular bead to allow only a portion of the peripheral rim of the mounting cup to contact the annular bead of the container when the mounting cup is disposed on the container. The inner region contour of the peripheral rim is deformed when the mounting cup is crimped to the annular bead of the container to reform the inner region contour of the peripheral rim to be substantially the same shape as the inner surface contour of the annular bead to provide a sealing engagement between the mounting cup and the container.

26 Claims, 3 Drawing Sheets

MOUNTING CUP

BACKGROUND OF THE INVENTION

1. Field of the Invention

This invention relates to dispensing and more particularly to aerosol dispensing devices incorporating a mounting cup or a closure for sealing with an aerosol container of the aerosol dispensing device.

2. Information Disclosure Statement

Aerosol containers and aerosol mounting cups have been so well known and so well established in the prior art that the basic shape and the basic dimensions of the aerosol containers and the mounting cups are standard in the aerosol industry. In the aerosol industry, an aerosol container is typically made of tin plated steel or aluminum and is provided with an opening in the container encircled by an annular bead for sealing with a peripheral rim formed in the mounting cup. The mounting cup receives an aerosol valve assembly for providing fluid communication between the interior of the aerosol container and the exterior of the aerosol container upon activation of the aerosol valve assembly by a user. The prior art has produced various types of aerosol valves, aerosol valve mechanisms, aerosol dispensing buttons, aerosol dispensing spouts, aerosol overcaps, and various other aerosol dispensing mechanisms for use with a variety of aerosol products as should be well known among those skilled in the art.

The aerosol valve mechanism and the mounting cup is typically fabricated at a valve assembly plant and shipped to a filling plant whereat the valve mechanism and mounting cup is sealed to the aerosol container with the aerosol product and the propellant retained therein. The mounting cup has a peripheral rim which is capable of being crimped to an annular bead located on the aerosol container to establish a seal between the mounting cup and the aerosol container. A plastic or rubber sealing material is located on the peripheral rim of the mounting cup for insuring the sealing engagement between the peripheral rim of the mounting cup and the annular bead of the aerosol container. The peripheral rim of the mounting cup is formed in a substantially inverted U-shaped configuration with the sealing material located in an interior space of the inverted U-shaped peripheral rim. The peripheral rim of the mounting cup is placed upon the annular bead of the aerosol container with the sealing material disposed therebetween. The mounting cup is then deformed or crimped by an expanding collet to bring the peripheral rim of the mounting cup into sealing engagement with the annular bead of the aerosol container.

In the past, numerous sealing materials and sealing devices have been proposed by the prior art for enhancing the seal between the peripheral rim of the mounting cup and the annular bead of the aerosol container. One of the first sealing materials utilized was a cured in place sealing material wherein a liquid sealing material was applied to an interior surface of the peripheral rim of the mounting cup. The liquid sealing material was cured through a sequence of curing ovens to evaporate volatile solvents from the liquid sealant material to leave a resilient residue on the interior surface of the peripheral rim for providing a fluid tight seal when the peripheral rim of the mounting cup was crimped to the annular bead of the aerosol container.

Others in the prior art have utilized mounting cups formed from a metallic sheet material which had been precoated or laminated with a plastic sealing material. As the mounting cup was formed from the laminated plastic and metallic sheet material, the laminated plastic sealing material was located within the peripheral rim of the mounting cup to provide a seal when the mounting cup was secured or crimped to the aerosol container.

Another proposal in the prior art for a mounting cup sealing material was the use of a preformed sleeve of plastic material which was inserted onto the peripheral rim of the mounting cup. The preformed sleeve of plastic material is set forth in the published European patent application under Ser. No. 0,033,626.

Another proposal in the prior art for a mounting cup sealing material is set forth in the Patent Cooperation Treaty Published patent application Ser. No. PCT/US83/01463 wherein a heated mounting cup was immersed within a vessel containing plastic particulate material. A thin coating of the plastic particulate material was thereby affixed to the heated mounting cup. The mounting cup with the affixed thin coating of the plastic particulate material was then removed from the vessel and was heated to produce a uniform coating of plastic sealing material on the interior surface of the peripheral rim of the mounting cup.

Although various proposals have been made in the prior art to improve the seal between the peripheral rim of the mounting cup and the annular bead of the aerosol container, little or no effort has been undertaken to improve the shape or configuration of the mounting cup. The seal between the peripheral rim of the mounting cup and the annular bead of the aerosol container remains of great concern to both the valve assembly plants and the filling plants since the seal between the mounting cup and the aerosol container must be capable of being gas tight for a period of years. In addition, the seal between the mounting cup and the aerosol container must be low in cost to enable aerosol products to be competitive with non-aerosol products in the consumer market.

The problem is further complicated by the fact that the various sealing materials namely, the cured in place sealing material, the plastic sleeve material, the laminated plastic sealing material, and the plastic particulate sealing material all have different thickness which may vary beyond the normal tolerances of the mounting cup and the annular bead of the aerosol container. Furthermore, although quality control is paramount in the aerosol industry, the peripheral rims of the mounting cups manufactured by the valve assembly plants and the annular beads of the aerosol container manufactured by container plants have nominal variations which are within quality control limits. In some cases, the difference in thickness of the plastic sealing materials and the nominal variations of the peripheral rims of the mounting cups and/or the annular beads of the containers are compounded to produce a defective seal in a completed aerosol product which may remain undetected until discovered by the ultimate consumer.

Accordingly, it should be realized that the seal between the mounting cup and the aerosol container is of prime importance to the aerosol industry. Furthermore, since the size and the shape of the annular bead of the aerosol container and the size and the shape of the mounting cup have been virtually unchanged for more than twenty years, it is not surprising that substantially all of the effort to enhance the seal between the mounting cup and the aerosol container has been directed to the sealing material located between the aerosol container and the mounting cup.

Therefore, it is an object of the present invention to provide an improved mounting cup for sealing with a container of an aerosol device wherein the peripheral rim of the mounting cup comprises an improved inner region contour which is deformed when the mounting cup is crimped to the annular bead of the aerosol container.

Another object of this invention is to provide an improved mounting cup for sealing with a container of an aerosol device wherein the improved inner region contour of the peripheral rim of the mounting cup allows only a portion of the peripheral rim to contact the annular bead of the container when the mounting cup is disposed on the container and which inner region contour of the peripheral rim is reformed to be substantially the same shape as the contour of the annular bead when the mounting cup is crimped to the aerosol container.

Another object of this invention is to provide an improved mounting cup for sealing with a container of an aerosol device wherein the improved inner region contour of the peripheral rim of the mounting cup adjusts for variations in the dimensions in the mounting cup peripheral rim and adjusts for variations in the dimensions in the annular bead of the container to provide a superior seal therebetween.

Another object of this invention is to provide an improved mounting cup for sealing with a container of an aerosol device which is suitable for use with a cured in place sealing material, a preformed plastic sleeve material, a laminated sealing material, a plastic particulate sealing material and all other types of sealing materials used in the aerosol industry.

Another object of this invention is to provide an improved mounting cup for sealing with a container of an aerosol device which comprises a new mounting cup shape prior to the crimping process but which has a conventional mounting cup shape subsequent to the crimping and sealing of the peripheral rim of the mounting cup to the annular rim of the aerosol container.

Another object of this invention is to provide an improved mounting cup for sealing with a container of an aerosol device wherein the improved mounting cup may be used with conventional crimping equipment in the aerosol industry.

Another object of this invention is to provide an improved mounting cup for sealing with a container of an aerosol device wherein the peripheral rim of the improved mounting cup has an initial shape substantially different from the shape of the annular bead of the container and which peripheral rim is reformed during the crimping process to have substantially the same shape as the annular bead of the aerosol container.

Another object of this invention is to provide an improved mounting cup for sealing with a container of an aerosol device which is suitable for use with all existing aerosol valves.

Another object of this invention is to provide an improved mounting cup for sealing with a container of an aerosol device wherein the improved mounting cup provides a superior seal independent of the sealing material without any additional cost in the fabrication of the mounting cup.

Another object of this invention is to provide an improved method for forming a seal between a mounting cup and a container of an aerosol device wherein the crimping of the mounting cup reforms the peripheral rim of the mounting cup to be substantially the same shape as the contour of the annular bead of the aerosol container to provide a sealing engagement between the mounting cup and the aerosol container.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention relates to an improved mounting cup for sealing with a container of an aerosol device, the container having an annular bead extending about an opening in the container and with the annular bead having an inner surface contour. The invention comprises a mounting cup having a peripheral rim for sealing with the annular bead of the container. The peripheral rim has an inner region contour being substantially different in shape from the inner surface contour of the annular bead of the container. The difference in the shape of the inner region contour of the peripheral rim from the shape of the inner surface contour of the annular bead allows only a portion of the inner region contour of the peripheral rim to contact the inner surface contour of the annular bead when the mounting cup is disposed on the container. The shape of the inner region contour of the peripheral rim is deformed when the mounting cup is crimped to the annular bead of the container. The deformation of the inner region contour reforms the shape of the inner region contour to be substantially the same shape as the inner surface contour of the annular bead to provide a sealing engagement between the mounting cup and the container.

In a more specific embodiment of the invention, the mounting cup is preferably formed of a material which is substantially more ductile than the material forming the annular bead of the container. Preferably, a sealing material is secured to the inner region contour of the peripheral rim for sealing any voids between the inner region contour of the peripheral rim and the inner surface contour of the annular bead when the mounting cup is crimped to the container.

In one embodiment of the invention, the inner surface contour of the annular bead has a generally partially circular cross-section defining a bead radius of curvature. The inner region contour of the peripheral rim has a rim radius of curvature substantially greater than the bead radius of curvature of the annular bead. The inner region contour of the peripheral rim may be provided with a generally flattened or slightly curved cross-section for allowing only a circular portion of the inner region contour of the peripheral rim to contact the inner surface contour of the annular bead when the mounting cup is disposed on the container.

The mounting cup includes a sidewall extending between a central area and the peripheral rim with the crimping of the mounting cup to the annular bead including the enlargement of the sidewall adjacent the annular bead to deform the inner region contour of the peripheral rim against the inner surface contour of the annular bead whereby the inner region contour of the peripheral rim is reformed into the shape of the inner surface contour of the annular bead and is established into sealing engagement therewith.

The invention is also incorporated into the method of forming a seal between a mounting cup and a container of an aerosol dispensing device. The container has an annular bead extending about an opening in the container with the annular bead having an inner surface contour. The method includes firstly, forming a peripheral rim in the mounting cup with the peripheral rim having an inner region contour being substantially different in shape from the inner surface contour of the annular bead of the container. Secondly, the peripheral rim of the mounting cup is placed on the annular bead of the container. Thirdly, the mounting cup is crimped in proximity to the inner region contour of peripheral rim to reform the inner region contour of the peripheral rim to be substantially the same shape as the inner surface contour of the annular bead to provide a sealing engagement between the mounting cup and the container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
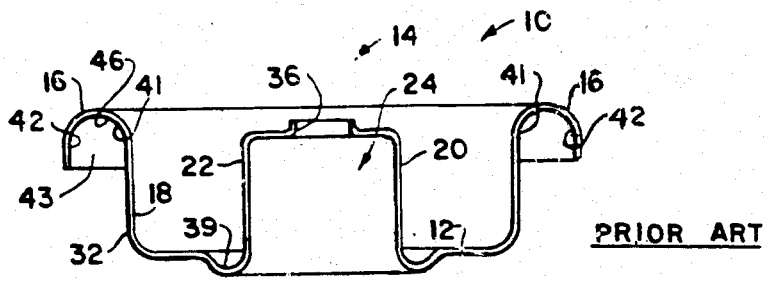
FIG. 1 is a side sectional view of a prior art mounting cup for an aerosol dispensing device.

FIG. 1 is a side sectional view of a prior art mounting cup 10 having a substantially flat base 12 disposed in a central area 14 with a peripheral rim 16 being integrally connected to the base 12 by a sidewall 18. The mounting cup 10 is shown including a mounting cup turret 20 formed in the central area 14 of the mounting cup 10. The mounting cup turret 20 is formed by sidewalls 22 for defining an interior cavity 24 of the turret 20 for accommodating an aerosol valve assembly 26 shown in FIGS. 2 and 3. The aerosol valve assembly 26 is crimped to the mounting cup 10 by crimps 28 with a valve body 30 of the aerosol valve assembly 26 being sealed to an internal surface 32 of the mounting cup 10 by a gasket 34. The mounting cup turret 20 also includes a valve stem orifice 36 for enabling a valve stem 38 to extend therethrough to provide fluid communication between the interior and the exterior of the aerosol device. An optional annular lip 39 is included for providing additional material to the mounting cup 10 when the mounting cup 10 is crimped to an aerosol container 40 as will be described in greater detail hereinafter. The aerosol valve assembly 26 is shown in FIGS. 2 and 3 without a valve button or an overcap but the operation of the aerosol valve assembly 26 should be well known to those skilled in the art and for the sake of clarity will not be further explained herein.

The peripheral rim 16 of the prior art mounting cup 10 is substantially an inverted U-shape having an inner region contour 41 and an outer region contour 42 which are generally partially circular in configuration defining an internal space 43 for receiving an annular bead 44 of the aerosol container 40 therein. The interior surface 32 of the mounting cup 10 in this embodiment is provided with a sealing material 46 for providing a fluid-tight seal between the peripheral rim 16 and the annular bead 44 of the aerosol container 40.

Figure 2:
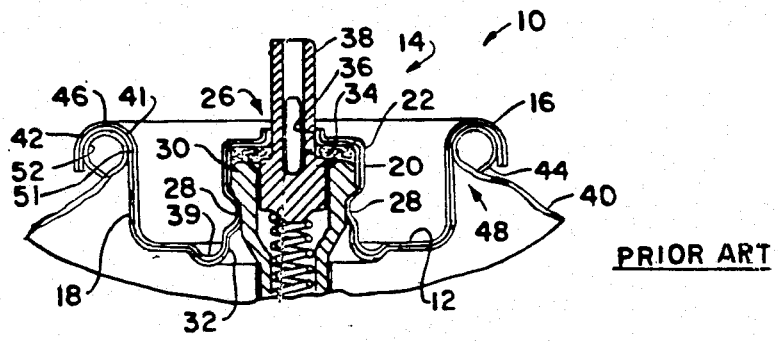
FIG. 2 is a side sectional view of the aerosol dispensing mechanism including an prior art mounting cup shown in FIG. 1 disposed upon an aerosol container.
Figure 3:
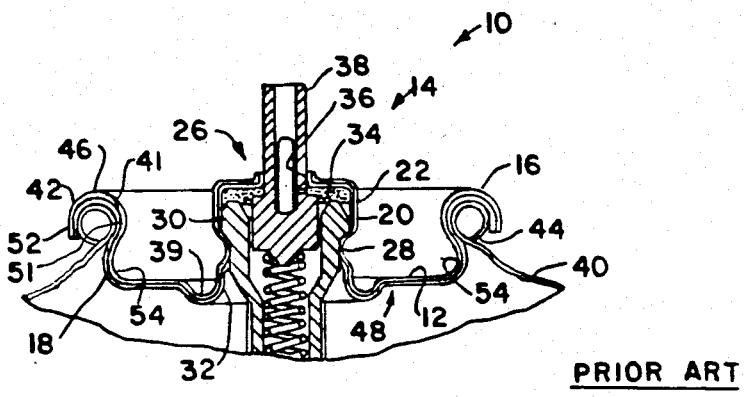
FIG. 3 is a side sectional view of the aerosol dispensing mechanism including the prior art mounting cup shown in FIG. 1 secured to the aerosol container.

The annular bead 44 extends about an opening 48 in the aerosol container 40 with the annular bead 44 being rolled into the configuration as shown in FIGS. 2 and 3 thereby defining an inner surface contour 51 proximate the opening 48 of the aerosol container 40 and an outer surface contour 52 remote from the opening 48 in the aerosol container 40. The annular bead 44 has a generally circular cross-section such that the inner surface contour 51 and the outer surface contour 52 are partially circular in cross-section as shown in FIGS. 2 and 3. In the prior art mounting cup 10, the inner region contour 41 and the outer region contour 42 has a radius of curvature substantially equal to the radius of curvature of the linear surface contour 51 and the outer surface contour 52, respectively, to enable the internal space 43 of the peripheral rim 16 to fully receive the annular bead 44. The annular bead 44 is typically constructed of a type T-2 or type T-3 tin-coated steel whereas the mounting cup 10 is made of a more ductile material such as type D T-1 tin-plated steel.

FIG. 2 illustrates the prior art mounting cup 10 being disposed upon the annular bead 44 of the aerosol container 40. As it can be clearly seen from FIG. 2, the inner region contour 41 and the outer region contour 42 of the peripheral rim 16 of the mounting cup 10 respectively engage the inner surface contour 51 and the outer surface contour 52 of the annular bead 44 of the aerosol container 40. In addition, virtually the entire internal space 43 of the peripheral rim 16 is occupied by the annular bead 44 of the container 40. Accordingly, in the prior art mounting cup 10, the inner region contour and the outer region contour 41 and 42 were specifically formed to fit with the inner surface contour and the outer surface contour of 51 and 52 of the annular bead 44 and to minimize any voids within the internal space 43.

FIG. 3 illustrates prior art mounting cup 10 secured to the aerosol container 40. The sidewall 18 of the mounting cup 10 is deformed by an expansion collet (not shown) to produce a mounting cup crimp 54 adjacent the annular bead 44 of the aerosol container 40 to provide a sealing engagement between the mounting cup 10 and the aerosol container 40. The prior art mounting cup 10 has been formed in the shape as shown in FIGS. 1–3 for many decades since it was believed that the fit as shown in FIG. 2 was the most advantageous to create a seal between the peripheral rim 16 and the annular bead 44. Accordingly, the majority of efforts of the prior art to improve the seal between the mounting cup 10 and the aerosol container 40 were concentrated into improving the sealing material 46 between the peripheral rim 16 and the annular bead 44.

Figure 4:
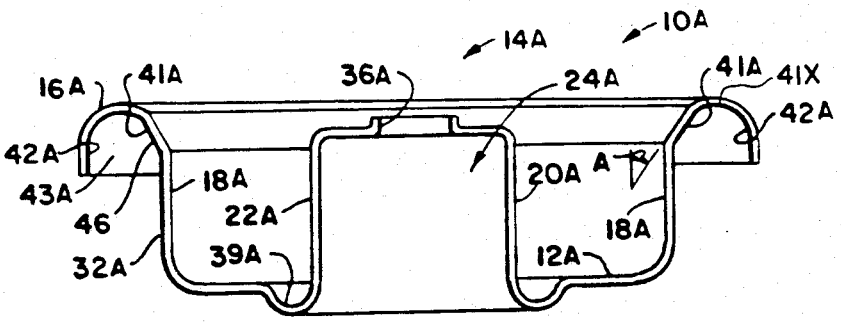
FIG. 4 is a side sectional view of a first embodiment of an improved mounting cup of the present invention.
Figure 5:
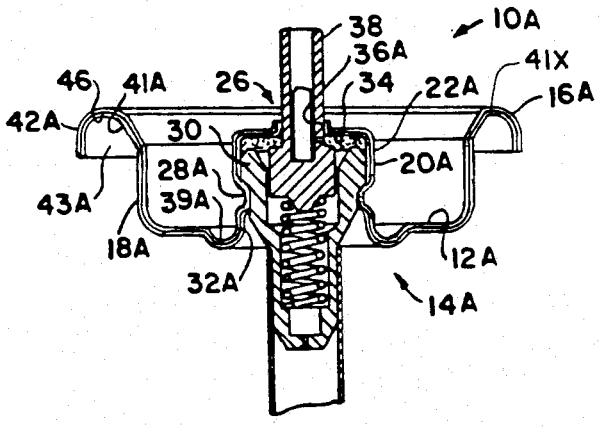
FIG. 5 is a side sectional view of an aerosol dispensing mechanism including the improved mounting cup of FIG. 4.

FIG. 4 is a side sectional view of a first embodiment of a mounting cup 10A of the present invention comprising a substantially flat base 12A disposed in a central area 14A with a peripheral rim 16A being integrally connected to the base 12A by a sidewall 18A. The mounting cup 10A is shown including a mounting cup turret 20A formed in the central area 14A of the mounting cup 10A. The mounting cup turret 20A is formed by sidewalls 22A for defining an interior cavity 24A of the turret 20A for accommodating the aerosol valve assembly 26 shown in FIGS. 5–8. The aerosol valve assembly 26 is identical to the aerosol valve assembly 26 shown in FIGS. 2 and 3 but it should be understood that any valve assembly incorporating a mounting cup or any valveless mounting cup is suitable for use with the present invention. The aerosol valve assembly 26 is crimped to the mounting cup 10A by crimps 28A with the valve body 30 of the aerosol valve assembly 26 being sealed to an interior sealing surface means 32A of the mounting cup 10A preferably by a gasket 34. The mounting cup turret 20A also includes a valve stem orifice 36A for enabling the valve stem 38 to extend therethrough to provide fluid communication between the interior and the exterior of the aerosol device. An optional annular lip 39A is included for providing additional material to the mounting cup 10A when the mounting cup is crimped to the aerosol container 40.

The peripheral rim 16A of an improved mounting cup 10A has an inner region contour 41A and an outer region contour 42A defining an interior space 43A for cooperating with the annular bead 44 of the aerosol container 40. In this embodiment the interior surface of the mounting cup 32A is provided with a sealing material 46 for defining the inner region contour 41A and the outer region contour 42A and to provide a fluid-tight seal between the peripheral rim 16A and the annular bead 44 of the aerosol container 40.

The outer region contour 42A of the peripheral rim 16A of the improved mounting cup 10A is generally partially circular in cross-section in a manner similar to the outer region contour 42 of the peripheral rim 16 of the prior art mounting cup 10 shown in FIGS. 1–3. In addition, the outer region contour 42A of the peripheral rim 16A has a radius of curvature substantially equal to the radius of curvature the outer surface contour 52 of the annular bead 40.

As can be clearly seen from FIG. 4, the inner region contour 41A of the peripheral rim 16A of the improved mounting cup 10A is substantially different in shape from the inner surface contour 51 of the annular bead 44. The inner region contour 41A of the peripheral rim 16A of the improved mounting cup 10A shown in FIG. 4, extends into the interior space 43 normally defined by the peripheral rim 16 of the prior art mounting cup 10 shown in FIG. 1. In the embodiment shown in FIG. 4, the inner region contour 41A comprises a flattened annular surface having a substantially linear cross-section and angularly disposed relative to the sidewall 18A of the mounting cup 10A. The substantially linear region forms an angle A of approximately 30 degrees relative to the sidewall 18A. Since the inner region contour 41A is shown as a linear tapered region, the radius of curvature of the inner surface region 41A is infinite but it should be understood that the inner surface contour 41A may be slightly curved about a large radius of curvature or may be convexly curved into the interior space 43A of the peripheral rim 16A to accomplish the intended purpose of the invention.

Figure 6:
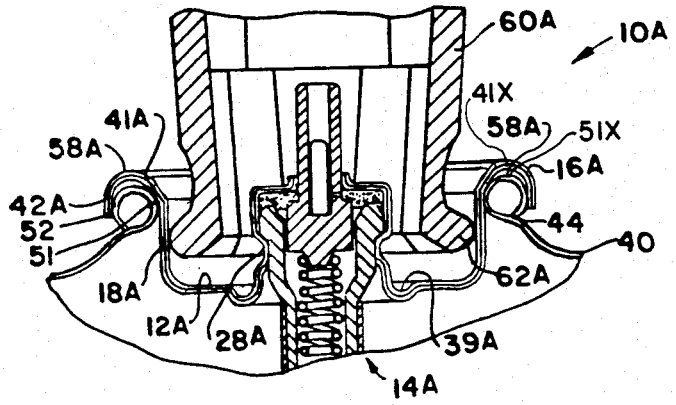
FIG. 6 is a side sectional view of the aerosol dispensing mechanism including the improved mounting cup of FIG. 4 being disposed upon an aerosol container.

In a manner identical to FIGS. 2 and 3, the annular bead 44 shown in FIG. 6 extends about an opening 48 in the aerosol container 40 with the annular bead 44 having an inner surface contour 51 proximate the opening 48 of the aerosol container 40 and an outer surface contour 52 remote from the opening 48 in the aerosol container 40. The annular bead 44 has a generally circular cross-section such that the inner surface contour 51 and the outer surface contour 52 are generally partially circular in cross-section as shown in FIGS. 5–8.

FIG. 6 illustrates the mounting cup 10A being disposed upon the aerosol container 40 with the peripheral rim 16A engaging the annular bead 44. As it can be clearly seen from FIG. 6, the inner region contour 41A forms an interference fit with the inner surface contour 51 to inhibit the complete seating of the mounting cup 10A on the annular bead 44 in contrast to the prior art shown in FIG. 2. The inner region contour 41A of the peripheral rim 16A allows only a portion of the inner region contour 41A to contact the inner surface contour 51 of the annular bead 44. Accordingly, only a circular portion of the inner region contour 41A of the peripheral rim 16A contacts the inner surface contour 51 of the annular bead when the mounting cup 10A is disposed on the aerosol container 40. Furthermore, the internal space 43A of the improved mounting cup 10A does not fully receive the annular bead 44 as the prior art mounting cup 10. In contrast to the prior art mounting cup 10, a void 58A is created between the peripheral rim 16A and the annular bead 44 as shown in FIG. 6. The interference fit between the inner region contour 41A and the inner surface contour 51 prohibits a rim apex 41X located at the intersection of the inner region contour 41A and the outer region contour 42A from contacting a bead apex 51X located at the intersection of the inner surface contour 51 and the outer surface contour 52.

The internal space 43 of the peripheral rim 16 of the prior art mounting cup 10 completely received the annular bead 44 as shown in FIG. 3 and was believed to provide the proper seating of the peripheral rim 16 on the annular bead 44 prior to the crimping process. The internal space 43A of the peripheral rim 16A of the mounting cup 10A of the present invention does not completely receive the annular bead 44 as shown in FIG. 6 prior to the crimping process. In view of the improved inner region contour 41A of the peripheral rim 16A of the present invention inhibiting the complete reception of the annular bead 44, one would expect that an improper seal would be created between the improved mounting cup 10A and the aerosol container 40. However, in contrast to what one would expect, the use of the improved inner region contour 41A to inhibit the peripheral rim 16A from completely receiving the annular bead 44 as shown in FIG. 6 produces an enhanced and more reliable seal than heretofore known in the art. FIG. 6 also illustrates an expandable collet 60A having an annular collet head 62A for crimping the mounting cup 10A into sealing engagement with the aerosol container 40.

Figure 7:
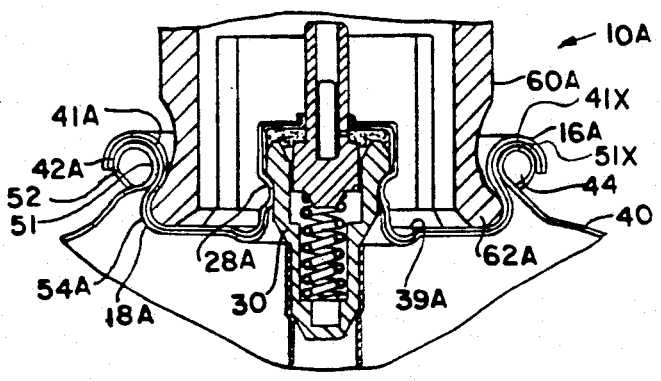
FIG. 7 is a side sectional view of the aerosol dispensing mechanism including the improved mounting cup of FIG. 4 being secured to the aerosol container.

FIG. 7 is a side sectional view illustrating the sealing engagement between the inner region contour 41A of the peripheral rim 16A of the mounting cup 10A and the annular bead 44 of the aerosol container 40. In this embodiment, the expandable collet 60A has been moved radially outwardly for enabling the annular collet head 62A to form a crimp 54A in the sidewall 18A of the mounting cup 10A. Simultaneously therewith, the expandable collet head 62A has reformed the inner region contour 41A to approximate the generally partially circular cross-section of the inner surface contour 51 of the annular bead 44. As the inner region contour 41A of the peripheral rim 16A is reformed into conformity with the inner surface contour 51 of the annular bead 44, the mounting cup 10A is brought into sealing engagement with the aerosol container 40. During the deforming process, the base 12A of the mounting cup 10A is raised in FIG. 7 to provide additional material to form the crimp 54A. Simultaneously therewith, the inner region contour 41A is drawn downwardly in FIG. 7 to a position whereat the inner region contour 41A of the mounting cup 10A provides a mating engagement with the inner surface contour 51 of the annular bead 44. The deformation of the mounting cup 10A during crimping reforms the inner region contour 41A over the surface of the inner surface contour 51 and moves the rim apex 41X into close proximity or contact with the bead apex 51X.

Figure 8:
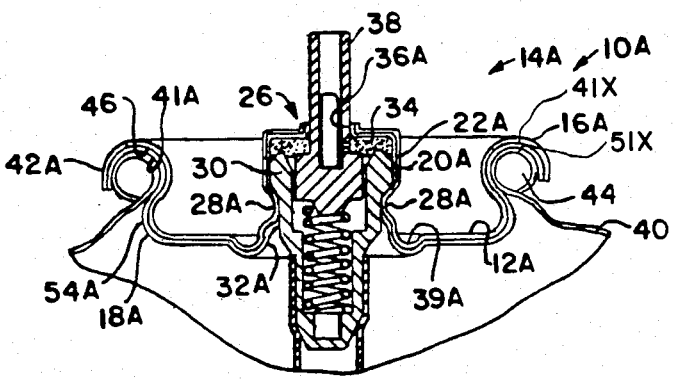
FIG. 8 is a side sectional view of the completed aerosol device with the aerosol dispensing mechanism of FIG. 5 shown secured to the aerosol container.

After formation of the crimp 54A shown in FIG. 7, the collet heads 62A are moved radially inwardly to a position as shown in FIG. 6 and are removed to provide the finished aerosol dispensing device as shown in FIG. 8. As it can be seen from an examination of FIGS. 3 and 8, the outward appearance of the peripheral rim 16A of the improved mounting cup 10A of the present invention is substantially the same as the outward appearance of the peripheral rim 16 of the prior art mounting cup 10. Accordingly, after crimping of the improved mounting cup 10A, the mounting cup 10A appears to be identical to the prior art mounting cup 10 to the casual observer.

In the prior art process, the peripheral rim 16 of the mounting cup 10 is positioned for complete contact with the annular bead 44 as shown in FIG. 2. In the event of a significant variation in the size or the shape of the peripheral rim 16 and/or the annular bead 44, a void is produced between the peripheral rim 16 and the annular bead 44. During the crimping of the prior art mounting cup 10, there is only little downward movement of the inner region contour 41 of the peripheral rim 16 relative to the annular bead 44 in FIG. 2. Thus leaks may develop between the peripheral rim 16 and the annular bead 44 at the point or points of the significant variation in the size or the shape of the peripheral rim 16 and/or the annular bead 44.

In the improved mounting cup 10A of the present invention, the inner region contour 41A of the peripheral rim 16A inhibits the peripheral rim 16A from completely contacting the annular bead 44 in contrast to the prior art mounting cup 10. Accordingly, during the crimping of the improved mounting cup 10A, there is significant downward movement of the inner region contour 41A of the peripheral rim 16A relative to the annular bead 44. The inner region contour 41A is drawn downwardly in FIG. 7 during the deformation process to a position whereat the inner region contour 41A is brought into tight engagement with the annular bead 44. The deformation process of the improved mounting cup 10A compensates for any variations in the size or the shape of the peripheral rim 16A and/or the annular bead 44 since the entire inner region contour 41A is selectively deformed during the crimping process. Accordingly, the peripheral rim 16A may be deformed to a greater degree or a lesser degree at the point or points of the significant variation in the size or the shape of the peripheral rim 16A and/or the annular bead 44. In contrast, the prior art sealing process relied on a complete and uniform contact of the peripheral rim 16 of the mounting cup 10 to the annular bead 44 prior to the crimping process as shown in FIG. 2. Thereafter, the prior art mounting cup was uniformly crimped without regard for any significant variation in the size or the shape of the peripheral rim 16 and/or the annular bead 44. The inner region contour 41A of the peripheral rim 16A functions as a wedge during the crimping process whereby the expandable collet head 62A will deform and draw down the peripheral rim 16A of the mounting cup 10A into sealing engagement with the annular bead 44 of the container 40. During the crimping process, the annular bead 44 of the container 40 functions as a fulcrum to reform the inner region contour 41A of the peripheral rim 16A. After the crimping process is completed, the inner region contour 41A remains in tight intimate contact with the annular bead 44 of the container 40 regardless of any nominal manufacturing variations that may be present in the peripheral rim 16A and/or the annular bead 44 of the container 40.

The present invention has been found useful with virtually any presently available aerosol valve dispensing devices incorporating a mounting cup as well as numerous types of cans or containers having an annular bead 44. The present invention also provides superior seals on containers constructed of different types of materials including but not limited to ferrous and nonferrous metals.

Figure 9:
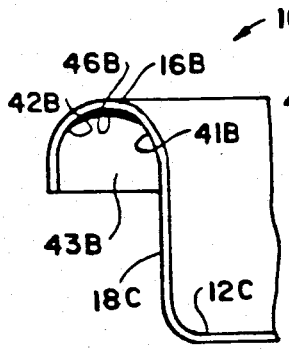
FIG. 9 is a side sectional view of a second embodiment of the improved mounting cup of the present invention.

FIG. 9 is a side sectional view of a portion of the improved mounting cup 10B wherein the inner region contour 41B is shown as a curve having a radius of curvature greater than the radius of curvature of the outer region contour 42B. In addition, FIG. 9 illustrates the use of a cured in place sealing material 46B as heretofore described.

Figure 10:
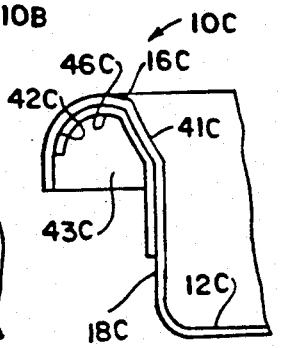
FIG. 10 is a side sectional view of a third embodiment of the improved mounting cup of the present invention.
Figure 11:
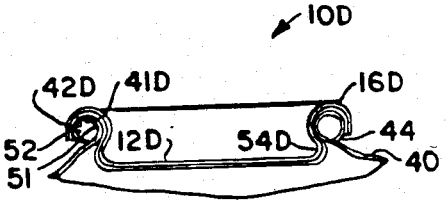
FIG. 11 is a side sectional view of a fourth embodiment of the improved mounting cup of the present invention shown secured to an aerosol container.

FIG. 10 is a side sectional view of a portion of the improved mounting cup 10C wherein the inner region contour 41C is a curved surface which convexly extends into the internal space 43C of the peripheral rim FIG. 11 is a side sectional view illustrating the invention being applied to a valveless mounting cup 10D. The nature and use of the valveless mounting cup 10D should well known to those skilled in the art.

Although numerous other configurations can be utilized for the inner region contour 41A, it is presently believed that the inner region contour 41A must extend into the space 43 normally defined by the prior art mounting cup 10 enabling the inner region contour 41A to inhibit the complete reception of the annular bead 44 into the peripheral rim 16A. Since the mounting cup 10A is prohibited from completely contacting the annular bead 44, then the peripheral rim 16A of the mounting cup can be drawn down on the annular bead 44 and deformed into conformity with the annular bead 44 as heretofore described.

The present disclosure comprises the foregoing specification and drawings and the appended claims. Although this invention has been described in the preferred form with a certain degree of particularity, it should be understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. An improved mounting cup for sealing with a container of an aerosol dispensing device, the container having an annular bead extending about an opening in the container with the annular bead having an inner surface contour, comprising in combination:

a metallic mounting cup comprising a central area, a sidewall and a peripheral rim with said sidewall interconnecting said central area and said peripheral rim;

said peripheral rim having an inner region contour being substantially different from the inner surface contour of the annular bead of the container for allowing only a portion of said inner region contour of said peripheral rim to contact the inner surface contour of the annular bead when said mounting cup is disposed upon the container;

said inner region contour of said peripheral rim being deformed when said mounting cup is crimped to the annular bead of the container to reform said inner region contour of said peripheral rim to be substantially the same as the inner surface contour of the annular bead to provide a seal engagement between said mounting cup and the container; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

2. An improved mounting cup as set forth in claim 1, wherein said metallic mounting cup is formed of a material which is substantially more ductile than the material forming the annular bead; and sealing means secured to said peripheral rim for defining said inner region contour of said peripheral rim.

3. An improved mounting cup for sealing with a container of an aerosol dispensing device, the container having an annular bead extending about an opening in the container with the annular bead having an inner surface contour, comprising in combination:

a metallic mounting cup comprising a central area, a sidewall and a peripheral rim with said sidewall interconnecting said central area and said peripheral rim;

said mounting cup having a sealing material secured thereto for defining an inner region contour of said peripheral rim with said inner region contour being substantially different from the inner surface contour of the annular bead of the container for allowing only a portion of said inner region contour of said peripheral rim to contact the inner surface contour of the annular bead when said mounting cup is disposed upon the container;

said inner region contour of said peripheral rim being deformed when said mounting cup is crimped to the annular bead of the container to reform said inner region contour of said peripheral rim to be substantially the same as the inner surface contour of the annular bead to provide a sealing engagement between said mounting cup and the container and with said sealing material sealing any voids between said inner region contour of said peripheral rim and said inner surface contour of the annular bead; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

4. An improved mounting cup for sealing with a container of an aerosol dispensing device, the container having an annular bead extending about an opening in the container with the annular bead having an inner surface contour, the inner surface contour of the annular bead having a partially circular cross-section defining a bead radius of curvature; comprising in combination:

a metallic mounting cup comprising a central area, a sidewall and a peripheral rim with said sidewall interconnecting said central area and said peripheral rim;

sealing means secured to said peripheral rim for defining an inner region contour being substantially different from the inner surface contour of the annular bead of the container for allowing only a portion of said inner region contour of said peripheral rim to contact the inner surface contour of the annular bead when said mounting cup is disposed upon the container;

said inner region contour of said peripheral rim having a rim radius of curvature substantially greater than the bead radius of curvature of the annular bead;

said inner region contour of said peripheral rim being deformed when said mounting cup is crimped to the annular bead of the container to reform said inner region contour of said peripheral rim to be substantially the same as the inner surface contour of the annular bead to provide a sealing engagement between said mounting cup and the container; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

5. An improved mounting cup as set forth in claim 2, wherein said inner surface contour of the annular bead has a partially circular cross-section; and said inner region contour of said peripheral rim having an annular surface for allowing only a circular portion of said inner region contour of said peripheral rim to contact the inner surface contour of the annular bead when said mounting cup is disposed upon the container.

6. An improved mounting cup for sealing with a container of an aerosol dispensing device, the container having an annular bead extending about an opening in the container with the annular bead having an inner surface contour, comprising in combination:

a metallic mounting cup comprising a central area and a peripheral rim for sealing with the annular bead of the container;

said mounting cup including a sidewall extending between said central area and said peripheral rim;

said peripheral rim having an inner region contour being substantially different from the inner surface contour of the annular bead of the container for allowing only a portion of said inner region contour of said peripheral rim to contact the inner surface contour of the annular bead when said mounting cup is disposed upon the container;

said inner region contour of said peripheral rim being deformed when said mounting cup is crimped to the annular bead of the container to reform said inner region contour of said peripheral rim to be substantially the same as the inner surface contour of the annular bead to provide a sealing engagement between said mounting cup and the container; and said crimping of said mounting cup to the annular bead of the container consisting solely of said sidewall being outwardly enlarged adjacent the annular bead to deform the inner region contour of said peripheral rim against the inner surface contour of the annular bead whereby said inner region contour of said peripheral rim is reformed into the shape of the inner surface contour of the annular bead and is established into sealing engagement therewith.

7. An improved mounting cup for sealing with a container of an aerosol dispensing device, the container having an annular bead extending about an opening in the container with the annular bead having an inner surface contour proximate the opening in the container and having an outer surface contour remote from the opening in the container and defining a bead apex therebetween, comprising in combination:

a metallic mounting cup comprising a central area and an annular sidewall supporting a peripheral rim for sealing with the annular bead of the container;

said peripheral rim having an inner region contour proximate said central area of said mounting cup and an outer region contour remote from said central area of said mounting cup;

said inner region contour and said outer region contour of said peripheral rim defining a rim apex therebetween;

said outer region contour of said peripheral rim being substantially the same as the outer surface contour of the annular bead of the container;

said inner region contour of said peripheral rim providing an interference fit between said peripheral rim of said mounting cup and the annular bead of the container to prohibit said rim apex of said peripheral rim from contacting the bead apex of the annular bead when said mounting cup is disposed upon the container;

said inner region contour of said peripheral rim being deformed when said mounting cup is crimped to the annular bead of the container to reform said peripheral rim of said mounting cup including moving said rim apex of said peripheral rim into contact with the bead apex of the annular bead to provide a sealing engagement between said mounting cup and the container; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

8. An improved mounting cup as set forth in claim 7, wherein said metallic mounting cup is formed of a material which is substantially more ductile than the material forming the annular bead; and sealing means secured to said peripheral rim for defining said inner region contour of said peripheral rim.

9. An improved mounting cup for sealing with a container of an aerosol dispensing device, the container having a annular bead extending about an opening in the container with the annular bead having an inner surface contour proximate the opening in the container and having an outer surface contour remote from the opening in the container and defining a bead apex therebetween, comprising in combination:

a metallic mounting cup comprising a central area and an annular sidewall supporting a peripheral rim for sealing with the annular bead of the container;

a sealing material secured to said peripheral rim for defining an inner region contour proximate said central area of said mounting cup and an outer region contour remote from said central area of said mounting cup;

said inner region contour and said outer region contour of said peripheral rim defining a rim apex therebetween;

said outer region contour of said peripheral rim being substantially the same as the outer surface contour of the annular bead of the container;

said inner region contour of said peripheral rim providing an interference fit between said peripheral rim of said mounting cup and the annular bead of the container to prohibit said rim apex of said peripheral rim from contacting the bead apex of the annular bead when said mounting cup is disposed upon the container;

said inner region contour of said peripheral rim being deformed when said mounting cup is crimped to the annular bead of the container to reform said peripheral rim of said mounting cup including moving said rim apex of said peripheral rim into close proximity to the bead apex of the annular bead to provide a sealing engagement between said mounting cup and the container and with said sealing materal sealing any voids between said inner region contour of said peripheral rim and said inner surface contour of the annular bead; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

10. An improved mounting cup as set forth in claim 7, wherein the inner surface contour of the annular bead has a partially circular cross-section defining a bead radius of curvature; and said inner region contour of said peripheral rim having a rim radius of curvature substantially greater than the bead radius of curvature of the annular bead.

11. An improved mounting cup as set forth in claim 7, wherein said inner surface contour of the annular bead has a partially circular cross-section; and said inner region contour of said peripheral rim having an annular surface for allowing only a circular portion of said inner region contour of said peripheral rim to contact the inner surface contour of the annular bead when said mounting cup is disposed upon the container.

12. An improved mounting cup as set forth in claim 9 wherein said inner surface contour of the annular bead has a partially circular cross-section; and said inner region contour of said peripheral rim having an annular surface for allowing only a circular portion of said inner region contour of said peripheral rim to contact the inner surface contour of the annular bead when said mounting cup is disposed upon the container.

13. An improved mounting cup for sealing with a container of an aerosol dispensing device, the mounting cup being crimped to the container solely by the application of an radially outward external force being applied to a portion of the mounting cup and void of any inward external force being applied to the mounting cup, the container having an annular bead extending about an opening in the container with the annular bead having a generally circular cross-section thereby defining an inner surface contour proximate the opening in the container and an outer surface contour remote from the opening in the container, comprising in combination:

a metallic mounting cup comprising a centrally disposed mounting cup turret for receiving an aerosol valve therein;

said mounting cup further comprising a peripheral rim supported by a sidewall for sealing engagement with the annular bead of the container;

said peripheral rim having an inner region contour proximate said mounting cup turret and an outer region contour remote from said mounting cup turret;

said outer region contour of said peripheral rim having a partially circular cross-section for matingly engaging with the generally circular cross-section of the outer surface contour of the annular bead of the container;

said inner region contour of said peripheral rim having an inclined linear cross-section for allowing only a portion of said inner region contour to engage the inner surface contour of the annular bead of the container when said mounting cup is disposed upon the aerosol container;

said inclined linear cross-section of said inner region contour of said mounting cup being deformed when said mounting cup is crimped to the annular bead of the container to approximate the generally circular cross-section of the inner surface contour of the annular bead to provide a sealing engagement between said mounting cup and the container; and said crimping being accomplished solely by the outward expansion of said sidewall by the radial outward external force.

14. An improved mounting cup as set forth in claim 13, wherein said metallic mounting cup is formed of a material which is substantially more ductile than the material forming the annular bead; and sealing means secured to said peripheral rim for defining said inner region contour of said peripheral rim.

15. An improved mounting cup for sealing with a container of an aerosol dispensing device, the mounting cup being crimped to the container solely by the application of a radially outward external force being applied to a portion of the mounting cup and void of any inward external force being applied to the mounting cup, the container having an annular bead extending about an opening in the container with the annular bead having a generally circular cross-section thereby defining an inner surface contour proximate the opening in the container and an outer surface contour remote from the opening in the container, comprising in combination:

a metallic mounting cup comprising a centrally disposed mounting cup turret for receiving an aerosol valve therein;

said mounting cup further comprising a peripheral rim supported by a sidewall for sealing engagement with the annular bead of the container;

said peripheral rim having an inner region contour proximate said mounting cup turret and an outer region contour remote from said mounting cup turret;

said outer region contour of said peripheral rim having a partially circular cross-section for matingly engaging with the generally circular cross-section of the outer surface contour of the annular bead of the container;

a sealing material secured to said inner region contour and said outer region contour of said peripheral rim;

said inner region contour of said peripheral rim having an inclined linear cross-section for allowing only a portion of said sealing means of said inner region contour to engage the inner surface contour of the annular bead of the container when said mounting cup is disposed upon the aerosol container;

said inclined linear cross-section of said inner region contour of said mounting cup being deformed when said mounting cup is crimped to the annular bead of the container to approximate the generally circular cross-section of the inner surface contour of the annular bead to provide a sealing engagement between said mounting cup and the container and with said sealing material sealing any voids between said inner region contour of said peripheral rim and said inner surface contour of the annular bead;

said crimping being accomplished solely by the outward expansion of said sidewall by the radial outward external force.

16. The method of forming a seal between a mounting cup and a container of an aerosol dispensing device, the container having an annular bead extending about an opening in the container with the annular bead having an inner surface contour, comprising the steps of:

forming a metallic mounting cup including a central area, a sidewall and a peripheral rim with the peripheral rim having sealing surface means for defining an inner region contour being substantially different from the inner surface contour of the annular bead of the container;

placing the peripheral rim of the mounting cup on the annular bead of the container with the inner region contour of the peripheral rim permitting only a portion of the inner region contour of the peripheral rim to contact the inner surface contour of the annular bead;

applying a radially outward force to the sidewall to radially expanding the sidewall of the mounting cup in proximity to the inner region contour of the peripheral rim to reform the inner region contour of the peripheral rim to be substantially the same as the inner surface contour of the annular bead to provide a sealing engagement between the mounting cup and the container; and the sealing engagement between the mounting cup and the container being accomplished solely by the application of the radially outward external force and void of any external inward force.

17. The method of forming a seal between a mounting cup and a container of an aerosol dispensing device, the container having an annular bead extending about an opening in the container with the annular bead having an inner surface contour proximate the opening in the container and having an outer surface contour remote from the opening in the container and with a bead apex being defined therebetween, comprising the steps of:

forming a metallic mounting cup including a central area, a sidewall and a peripheral rim with the peripheral rim having sealing surface means defining an inner region contour and an outer region contour with the inner region contour and the outer region contour of the peripheral rim defining a rim apex therebetween;

placing the mounting cup of the container with the inner region contour of the peripheral rim inhibiting the rim apex of the peripheral rim of the mounting cup from contacting the bead apex of the annular bead of the container;

radially expanding the sidewall of the mounting cup in proximity to the inner region contour of peripheral rim to reform the inner region contour of the peripheral rim of the mounting cup including moving the rim apex of the peripheral rim into close proximity to the bead apex of the annular bead to provide a sealing engagement between the mounting cup and the container, and the sealing engagement between the mounting cup and the container being accomplished solely by the application of the radially outward external force and void of any external inward force.

18. The method of forming a seal between a mounting cup and a container of an aerosol dispensing device, the container having an annular bead extending about an opening in the container with the annular bead having a partially circular inner surface contour proximate the opening in the container and having a partially circular outer surface contour remote from the opening in the container and with a bead apex being defined therebetween, comprising the steps of:

forming a metallic mounting cup including a central area, a sidewall and a peripheral rim with the peripheral rim having sealing surface means defining a non-circular inner region contour proximate the central area of the mounting cup and a partially circular outer region contour remote from the central area of the mounting cup with the inner region contour and the outer region contour of the peripheral rim defining a rim apex therebetween;

placing the mounting cup on the container with the non-circular inner region contour of the peripheral rim inhibiting the proper seating of the peripheral rim of the mounting cup on the partially circular annular bead of the container and inhibiting the rim apex of the peripheral rim of the mounting cup from contacting the bead apex of the annular bead of the container;

radially expanding the sidewall of the mounting cup in proximity to the non-circular inner region contour of the peripheral rim to reform the non-circular inner region contour of the peripheral rim to be partially circular and substantially the same as the partially circular inner surface contour of the annular bead and to move the rim apex of the peripheral rim into close proximity to the bead apex of the annular bead to provide a sealing engagement between the mounting cup and the container; and the sealing engagement between the mounting cup and the container being accomplished solely by the application of the radially outward external force and void of any external inward force.

19. A preformed metallic mounting cup for sealing with a container of an aerosol dispensing device, the container including an annular bead having an inner surface contour defining an opening in the container, comprising:

a mounting cup having a base integrally connected to a sidewall;

a peripheral rim integrally connected to said sidewall with said peripheral rim having an inner region contour and an outer region contour with an intersection therebetween;

said sidewall of said mounting cup proximate said base being dimensionally preformed to allow insertion into the opening in the container;

said mounting cup being dimensionally preformed for providing an interference fit between said inner surface contour of the annular bead of the container and a portion of said mounting cup remote from said intersection of said inner region contour and said outer region contour of said peripheral rim allowing only a portion of said inner region contour to contact the inner surface contour of the annular bead;

said inner region contour of sid peripheral rim being reformed to be substantially the same as the inner surface contour of the annular bead of the container when said sidewall of said mounting cup is radially expanded outwardly during the crimping of said mounting cup to the annular bead of the container to provide a sealing engagement between said mounting cup and the container, and said radial expansion of said sidewall of said mounting cup being accomplished solely by the application of a radially outward external force and void of any external inward force.

20. A preformed metallic mounting cup for sealing with a container of an aerosol dispensing device, the container having an annular bead, the annular bead having an inner surface contour and an outer surface contour with the inner surface contour defining an opening in the container, comprising:

a mounting cup having a base integrally connected to a sidewall;

said mounting cup having a peripheral rim integrally connected to said sidewall of said mounting cup for sealing with the annular bead of the container;

said peripheral rim of said mounting cup having sealing surface means for at least partially defining an inner region contour and an outer region contour with an intersection therebetween;

means establishing said outer region contour of said peripheral rim of said mounting cup for matingly engaging with the outer surface contour of the annular bead of the container;

means establishing said inner region contour of said peripheral rim of said mounting cup for cooperating with the inner surface contour of the annular bead of the container;

said mounting cup providing a dimensional clearance between said sidewall proximate said base of said mounting cup and the inner surface contour of the annular bead of the container for enabling insertion of said mounting cup into the opening in the container;

said mounting cup being dimensionally preformed for providing an interference fit between a portion of said mounting cup remote from said intersection of said inner region contour and said outer region contour of said peripheral rim and the inner surface contour of the annular bead of the container when said mounting cup is disposed upon the aerosol container allowing only a portion of said inner region contour to contact the inner surface contour of the annular bead;

said sidewall of said mounting cup being radially expanded outwardly during the crimping of said mounting cup to the annular bead of the container to reform said inner region contour of said peripheral rim to be substantially the same as the surface of the inner surface contour of the annular bead of the container and to provide a sealing engagement between said inner region contour and the inner surface contour and to provide a mating engagement between said outer region contour of said mounting cup and the outer surface contour of the annular bead of the container, and said radial expansion of said sidewall of said mounting cup being accomplished solely by the application of a radially outward external force and void of any external inward force.

21. A preformed metallic mounting cup for sealing with a container of an aerosol dispensing device, the container including an annular bead having an inner surface contour defining an opening in the container, comprising:

a mounting cup having a base integrally connected to a sidewall;

a peripheral rim integrally connected to said sidewall with said peripheral rim having an inner region contour intersecting with an outer region contour;

said inner region contour and said outer region contour of said peripheral rim having sealing surface means;

said mounting cup being dimensionally preformed for enabling said sidewall of said mounting cup proximate said base to be inserted into the opening in the container;

said mounting cup being dimensionally preformed for providing an interference fit between a portion of said sealing surface means of said mounting cup and the inner surface contour of the annular bead of the container and for preventing said intersection of sealing surface means of said inner region contour and said outer region contour of said peripheral rim from contacting said annular bead of said container;

said inner region contour of said peripheral rim being reformed into sealing engagement with the inner surface contour of the annular bead of the container when said sidewall of said mounting cup is radially expanded outwardly during the crimping of said mounting cup to the annular bead of the container including moving said intersection of said sealing surface means of said inner region contour and said outer region contour into close proximity to the annular bead to provide a sealing engagement between said mounting cup and the container; and said radial expansion of said sidewall of said mounting cup being accomplished solely by the application of a radially outward external force and void of any external inward force.

22. A preformed metallic mounting cup for sealing with a container of an aerosol dispensing device, the container having an annular bead, the annular bead having a generally circular cross-section including an inner surface contour and an outer surface contour and with said inner surface contour defining an opening in the container, comprising:

a mounting cup having a base integrally connected to a sidewall;

said mounting cup having a peripheral rim integrally connected to said sidewall with said peripheral rim having an inner region contour intersecting with an outer region contour;

said outer region contour of said peripheral rim of said mounting cup having a partially circular cross-section for matingly engaging with the generally circular cross-section of the outer surface contour of the annular bead of the container;

said mounting cup providing a dimensional clearance between a portion of said sidewall proximate said base of said mounting cup and the inner surface contour of the annular bead of the container for enabling insertion of said mounting cup into the opening in the container;

said mounting cup being dimensionally preformed for providing an interference fit between a portion of said mounting cup and the inner surface contour of the annular bead of the container and for preventing said intersection of said inner region contour and said outer region contour of said peripheral rim from contacting said annular bead of said container; and said inner region contour of said peripheral rim being reformed when said sidewall of said mounting cup is radially expanded outwardly during the crimping of said mounting cup to the annular bead of the container to reform said interference fit and to provide a mating engagement between said outer region contour of said mounting cup and the outer surface contour of the annular bead of the container and to provide a sealing engagement between said inner region contour of said mounting cup and the inner surface contour of the annular bead of the container to seal said mounting cup to the container.

23. An improved mounting cup for sealing with a container of an aerosol dispensing device, the container having an annular bead extending about an opening in the container with the annular bead having an inner surface contour proximate the opening in the container and having an outer surface contour remote from the opening in the container and defining a bead apex therebetween, comprising in combination:

a metallic mounting cup comprising a central area and an annular sidewall supporting a peripheral rim for sealing with the annular bead of the container;

said peripheral rim having an inner region contour proximate said central area of said mounting cup and an outer region contour remote from said central area of said mounting cup;

said inner region contour and said outer region contour of said peripheral rim defining a rim apex therebetween;

said outer region contour of said peripheral rim being substantially the same as the outer surface contour of the annular bead of the container;

said inner region contour of said peripheral rim providing an interference fit between said peripheral rim of said mounting cup and the annular bead of the container establishing a spaced relationship between said rim apex of said peripheral rim and the bead apex of the annular bead when said mounting cup is disposed upon the container;

said inner region contour of said peripheral rim being deformed when said mounting cup is crimped to the annular bead of the container to reform said peripheral rim of said mounting cup including moving said rim apex of said peripheral rim into close proximity to the bead apex of the annular bead and providing a sealing engagement between said mounting cup and the container, and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

24. In a preformed metallic mounting cup for sealing with a container of an aerosol dispensing device, the container including an annular bead having an inner surface contour defining an opening in the container, the mounting cup having a base integrally connected to a sidewall supporting a peripheral rim with the peripheral rim having an inner region contour intersecting with an outer region contour;

the mounting cup further being dimensionally preformed for enabling the sidewall of the mounting cup proximate the base to be inserted into the opening in the container;

the improvement comprising:

said mounting cup being dimensionally preformed for providing an interference fit between a portion of said mounting cup and the inner surface contour of the annular bead of the container for preventing said intersection of said inner region contour and said outer region contour of said peripheral rim from contacting said annular bead of said container;

said inner region contour of said peripheral rim being reformed into sealing engagement with the inner surface contour of the annular bead of the container including moving said intersection of said inner region contour and said outer region contour into close proximity to the annular bead when said sidewall of said mounting cup is radially expanded outwardly during crimping of said mounting cup to the annular bead of the container to provide a sealing engagement between said mounting cup and the container; and said radial expansion of said sidewall of said mounting cup during crimping being accomplished solely by the application of a radially outward external force and void of any external inward force.

25. In a preformed metallic mounting cup for sealing with a container of an aerosol dispensing device, the container including an annular bead having an inner surface contour defining an opening in the container, the mounting cup having a base integrally connected to a sidewall and supporting a peripheral rim with the peripheral rim having sealing surface means for defining an inner region contour intersecting with an outer region contour;

the mounting cup further being dimensionally preformed for enabling the sidewall of the mounting cup proximate the base to be inserted into the opening in the container;

the improvement comprising:

said inner region contour of said peripheral rim being substantially different from the inner surface contour of the annular bead of the container for allowing only a portion of said inner region contour of said peripheral rim to contact the inner surface contour of the annular bead when said mounting cup is disposed upon the container;

said inner region contour of said peripheral rim being deformed when said mounting cup is crimped to the annular bead of the container to reform said inner region contour of said peripheral rim to be substantially the same as the inner surface contour of the annular bead to provide a sealing engagement between said mounting cup and the container; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

26. In a preformed metallic mounting cup for sealing with a container of an aerosol dispensing device, the container having an annular bead extending about an opening in the container with the annular bead having an inner surface contour proximate the opening in the container and having an outer surface contour remote from the opening in the container and defining a bead apex therebetween, the metallic mounting cup comprising a central area and an annular sidewall supporting a peripheral rim for sealing with the annular bead of the container; the peripheral rim having an inner region contour proximate the central area of the mounting cup and an outer region contour remote from the central area of the mounting cup; the inner region contour and the outer region contour of the peripheral rim defining a rim apex therebetween; and the outer region contour of the peripheral rim being substantially the same as the outer surface contour of the annular bead of the container;

the improvement comprising:

said inner region contour of said peripheral rim providing an interference fit between said peripheral rim of said mounting cup and the annular bead of the container to prohibit said rim apex of said peripheral rim from contacting the bead apex of the annular bead when said mounting cup is disposed upon the container;

said inner region contour of said peripheral rim being deformed when said mounting cup is crimped to the annular bead of the container to reform said peripheral rim of said mounting cup including moving said rim apex of said peripheral rim into contact with the bead apex of the annular bead to provide a sealing engagement between said mounting cup and the container; and said crimping of said mounting cup to the annular bead of the container being accomplished solely by an outward radial expansion of said sidewall of said mounting cup to reform said inner region contour of said peripheral rim to be substantially the same as the inner surface contour of the annular bead to provide said sealing engagement between said mounting cup and the container.

* * * * *

UNITED STATES PATENT AND TRADEMARK OFFICE

CERTIFICATE OF CORRECTION

PATENT NO. : 4,792,067

DATED : December 20, 1988

INVENTOR(S) : James E. Greenbaum

It is certified that error appears in the above-identified patent and that said Letters Patent is hereby corrected as shown below:

In the Specification

Column 5, line 53, delete "an" and insert therefor --the--.
Column 6, line 66, delete "linear" and insert therefor --inner--.
Column 7, line 64, delete "an" and insert therefor --the--.

Column 11, line 9, after "rim" insert --16C--.

In the Claims

Claim 19, column 19, line 5, delete "sid" and insert therefor --said--.
Claim 25, column 22, line 42, after "sidewall" delete "and".

Signed and Sealed this

Nineteenth Day of December, 1989

*Attest:*

JEFFREY M. SAMUELS

*Attesting Officer* *Acting Commissioner of Patents and Trademarks*

US004792067B1

REEXAMINATION CERTIFICATE (3731st)

United States Patent [19] [11] B1 4,792,067

Greenebaum, II [45] Certificate Issued Feb. 16, 1999

[54] MOUNTING CUP

[75] Inventor: James E. Greenebaum, II, Highland Park, Ill.

[73] Assignee: Aptargroup, Inc., Crystal Lake, Ill.

Reexamination Request:
No. 90/004,872, Dec. 15, 1997

Reexamination Certificate for:

| | |
|---|---|
| Patent No.: | **4,792,067** |
| Issued: | **Dec. 20, 1988** |
| Appl. No.: | **733,207** |
| Filed: | **May 13, 1985** |

Certificate of Correction issued Dec. 19, 1989.

[51] Int. Cl.[6] ..... B65D 83/14

[52] U.S. Cl. ..... 222/402.1; 222/542; 413/62

[58] Field of Search ..... 222/402.1, 402.21–402.25, 222/542, 402.16, 402.2; 413/7, 42–44, 58–62; 53/470, 330, 488–489; 220/614, 617, 619

[56] References Cited

U.S. PATENT DOCUMENTS

| | | |
|---|---|---|
| 4,450,985 | 5/1984 | Beard . |
| 4,832,236 | 5/1989 | Greaves . |

FOREIGN PATENT DOCUMENTS

| | | | |
|---|---|---|---|
| 2417629 | 4/1973 | Germany | B65D 83/14 |
| 80233 | 8/1984 | Greece . | |
| 41-11238 | 6/1966 | Japan . | |

*Primary Examiner*—Kenneth Bomberg

[57] ABSTRACT

An apparatus and method is disclosed for an improved mounting cup for sealing with a container of an aerosol device. The container includes an annular bead extending about an opening in the container with the annular bead defining an internal surface contour having a generally partially circular cross-section. A mounting cup comprising a peripheral rim is formed for sealing with the annular bead of the container. The peripheral rim has an inner region contour substantially different in shape from the inner surface contour of the annular bead of the container. The inner region contour of the peripheral rim engages with the inner surface contour of the annular bead to allow only a portion of the peripheral rim of the mounting cup to contact the annular bead of the container when the mounting cup is disposed on the container. The inner region contour of the peripheral rim is deformed when the mounting cup is crimped to the annular bead of the container to reform the inner region contour of the peripheral rim to be substantially the same shape as the inner surface contour of the annular bead to provide a sealing engagement between the mounting cup and the container.

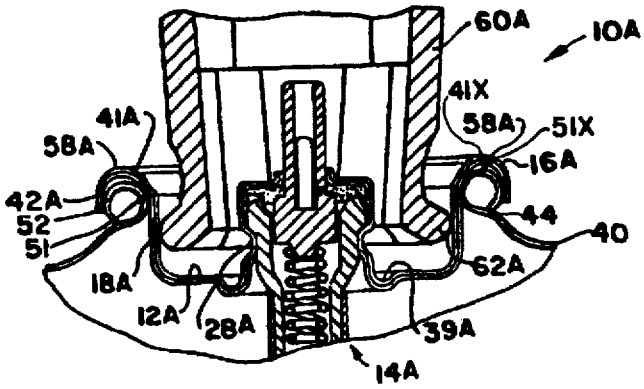

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–26 is confirmed.

* * * * *